US006074712A

United States Patent [19]

Ramirez

[11] Patent Number: 6,074,712

[45] Date of Patent: Jun. 13, 2000

[54] DECORATIVE BOW

[75] Inventor: James R. Ramirez, Kansas City, Mo.

[73] Assignee: Hallmark Cards, Inc., Kansas City, Mo.

[21] Appl. No.: 09/158,129

[22] Filed: Sep. 22, 1998

[51] Int. Cl.[7] ..... D04D 7/10

[52] U.S. Cl. ..... 428/4; 2/244

[58] Field of Search ..... 428/4, 5; 2/244

[56] References Cited

U.S. PATENT DOCUMENTS

| | | | |
|---|---|---|---|
| D. 314,732 | 2/1991 | Weder | D11/164 |
| D. 350,312 | 9/1994 | Edwards | D11/184 |
| D. 350,313 | 9/1994 | Edwards | D11/184 |
| 2,104,248 | 1/1938 | Stark | 428/5 |
| 2,806,313 | 9/1957 | James | 428/5 |
| 3,112,240 | 11/1963 | Kravig et al. | 428/5 |
| 3,229,869 | 1/1966 | Thayer | 223/46 |
| 4,726,509 | 2/1988 | Fonas | 428/4 X |
| 5,156,893 | 10/1992 | Barthe | 428/4 |
| 5,292,003 | 3/1994 | Baghdassarian | 428/4 X |

OTHER PUBLICATIONS

Gifts and Decorative Accessories Magazine, Part I, Jul. 1988, back cover.

The Ragen Multi–Bow with microprocessor controls. Photograph.

*Primary Examiner*—Henry F. Epstein

[57] ABSTRACT

A decorative bow is disclosed which comprises at least one sheet of material that is gathered around an insert and fastened together in a gathered configuration with a tie. A bow chip may be attached to the bow. The bow chip provides a stable backing on which information may be printed. The bow chip may include a removable pull-off strip exposing adhesive enabling the end user to affix the bow to a desired object.

24 Claims, 4 Drawing Sheets

DECORATIVE BOW

FIELD OF THE INVENTION

The present invention relates generally to the art of decorating such things as gift packages and gift bags with decorative bow structures. More particularly, this invention addresses the need to provide customers with alternatives to the traditional form of decorative ornaments that are used to prepare attractively wrapped packages by providing a new and unique ornamental bow.

BACKGROUND OF THE INVENTION

There are various bow structures available for the decoration of gift bags and packages. The bow structures pervading the market traditionally consist of continuous strips of ribbon material twisted in such a way as to create a succession of multiple loops radiating from a common point. These geometrically symmetrical loops may come in a variety of shapes, including a puff-type shape, in which the loops are smooth curves, and a conoidal shape, in which the loops are twisted to form a point. Since the traditional decorative bows typically consist of a multitude of loops arranged in a geometric pattern, and regardless of subtle variations in the shape of the loops, these traditional bows share a similar overall shape and appearance. Another popular type of decorative bow is in the shape of a pompon.

In contrast, the bow of the present invention presents a unique shape resembling a flower. The bow achieves its unique structure and appearance without the use of ribbon. The bow of the invention provides customers with a new and unique alternative to the traditional types of decorative bows.

SUMMARY OF THE INVENTION

The bow of the present invention is highly suited for use as an ornamental decoration that is an alternative to the traditional bow structure. The bow of he present invention comprises at least one sheet of material that is gathered around an insert and fastened together in a gathered configuration with a tie. When wrapped around the insert and tied with the tie, the material forms a decorative bow. In preferred bow structures of the invention three sheets of material are preferably gathered together although any number of sheets may be used. Moreover, a bow chip may be attached to the bow. The bow chip provides a stable backing on which information may be printed. The bow chip may include a removable pull-off strip exposing adhesive enabling the end user to affix the bow to a desired object. Further, the bow chip may include a hanger portion which permits the bow of the invention to be displayed on typical hanging display racks.

BRIEF DESCRIPTION OF THE DRAWINGS

The following detailed description of a preferred embodiment of the invention will be better understood when read in conjunction with the appended drawings. For the purpose of illustrating the present invention, the drawings show an embodiment which is presently preferred. It should be understood, however, that the present invention is not limited to the particular arrangement shown. In the drawings.

DESCRIPTION OF THE PREFERRED EMBODIMENT

Figure 1:
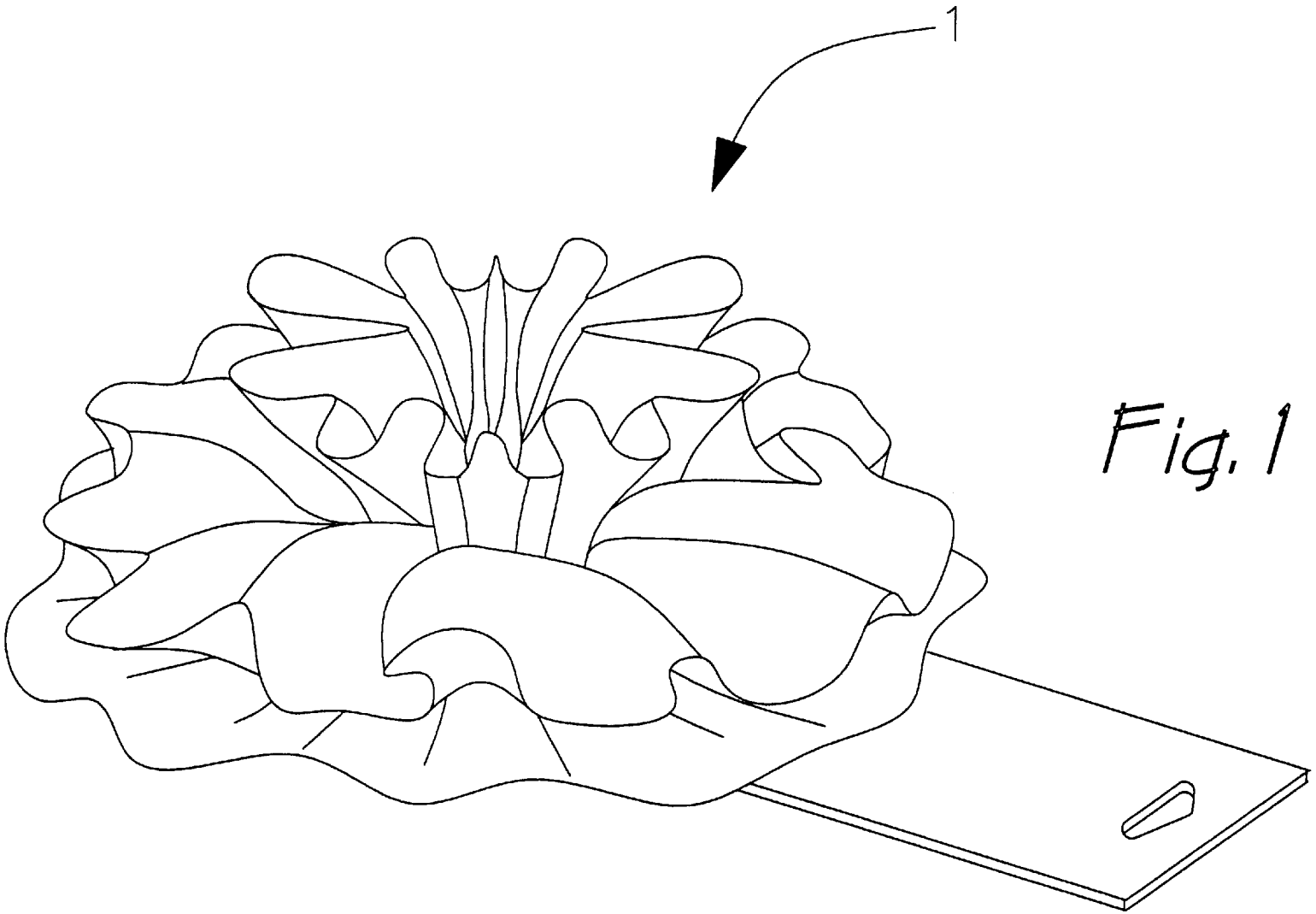
FIG. 1 is a perspective view of the present invention, wherein the bow is comprised of three sheets of material wrapped around an insert in the shape of a flat disc, and fastened together by a thin tie.

Referring now to FIG. 1, the bow 1 of the present invention comprises at least one sheet of material 12 that is gathered around an insert 10 and fastened together in a gathered configuration with a tie 18. When wrapped around the insert 10 and tied with the tie 18, the material forms a decorative bow 1. The bow 1 of the present invention resembles a flower, as opposed to a multitude of loops of ribbon.

Figure 2:
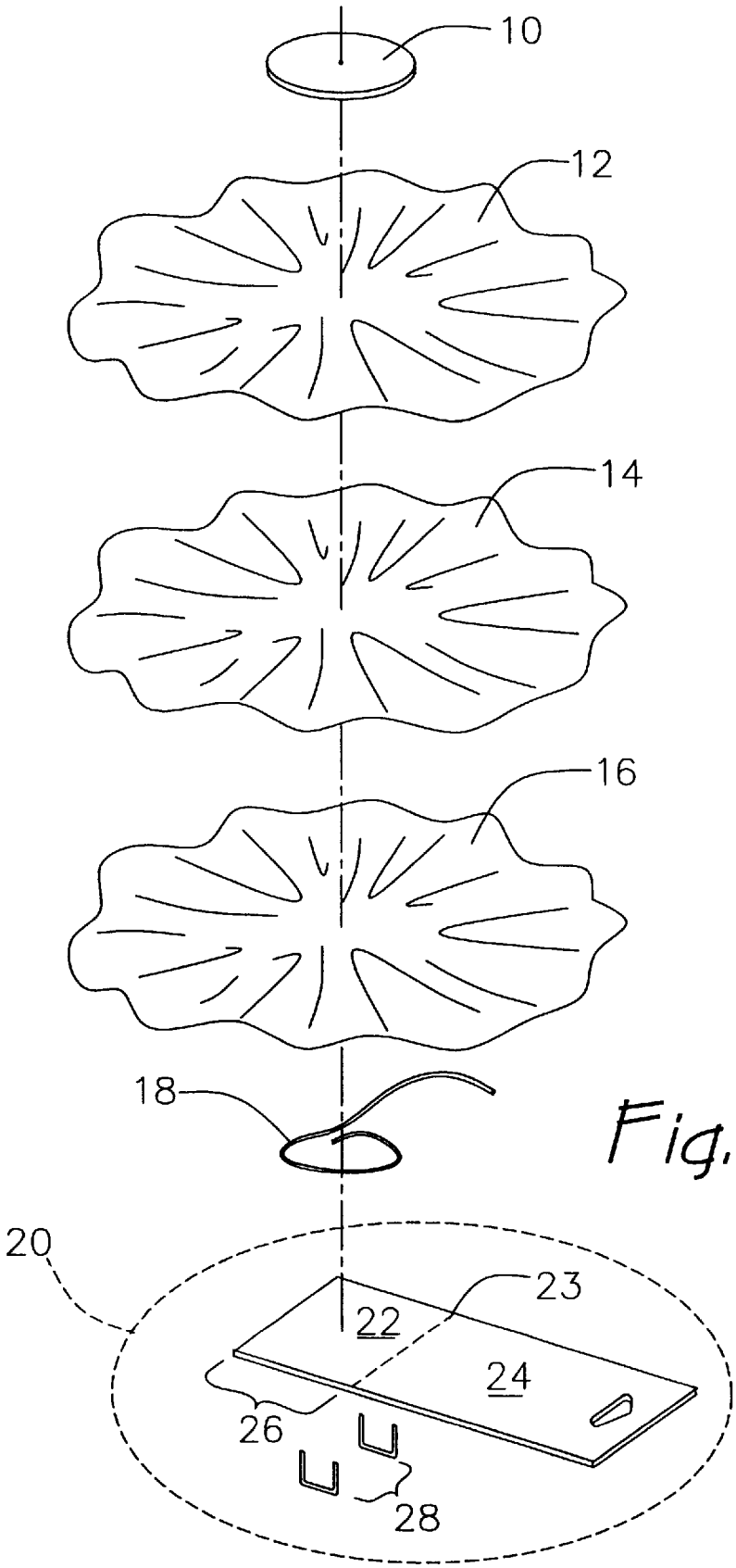
FIG. 2 is an exploded view of the components of the bow of FIG. 1.

As seen in FIG. 2, the components of the bow are assembled in a stacking configuration. The bow 1 comprises at least one, preferably three, sheets of material 12, 14, 16 that are circular and of uniform size. The sheets of material 12, 14, 16 are layered and stacked one on top of the other. A flat insert 10 is centered on the topmost sheet 12. The sheets 12, 14, 16 are wrapped around the insert 10, gathered together tightly, and fastened in the gathered state closely to the insert 10 with a tie 18. The bow chip 20 may be added to the back of the bow 1. The bow chip 20 comprises a main portion 22 and an extended portion 24. The bow chip is attached to the bow 1 preferably using one or more staples 28 through the sheet 16 at the bottom of the stack, attaching the bow chip 20 to the insert 10 and securing the sheets of material 12, 14, 16 in place. After assembly, the sheets of material 12, 14, 16 are fluffed out to shape the petals of the flower-like bow 1.

The insert 10 in FIG. 2 is flat and circular. However, the insert 10 may retain any other shape that suggests itself to one skilled in the art, as long as the thickness of the insert 10 is relatively insignificant compared to the overall height of the bow 1. The insert 10 may be made of plastic, cardboard, heavy paperboard, paper, or any other suitable material. Preferably, the insert 10 is about 1 3/16" in diameter where an approximately 4" diameter bow is to be formed. For larger diameter bows, a 1 3/16" diameter insert is also appropriate. Further, the insert 10 is preferably about 1/32" to 1/16" thick where an approximately 4" diameter bow is to be formed. For larger diameter bows, inserts of about 1/32" to 1/16" thick are also suitable. The insert 10 is circular in the preferred embodiment, but it may be square, polygonal or any other suitable shape that suggests itself.

Although there are three sheets of material 12, 14, 16 in the preferred embodiment, any number of sheets greater than or equal to one may be used to form the bow 1. The more sheets of material are used in construction, the more floral petals become apparent in the bow 1. The material may be made of foil, Mylar, paper, plastic, tulle, fabric, film material, or any other material that suggests itself to one skilled in the art. The sheets 12, 14, 16 in the preferred embodiment are of uniform size and round shape, but the relative size of the layered sheets may vary to give the bow an alternative look. Preferably, the sheets 12, 14, 16 are about 6 3/8" in diameter where an approximately 4" diameter bow is to be formed. Further, the sheets 12, 14, 16 will vary in thickness depending upon the material selected but generally must be sufficiently thin to permit formation of the bow. Additionally, the sheets may take on a shape that is not perfectly circular; the sheets may be round with scalloped edges, polygonal, or any other shape that suggests itself. The texture of the material need not be smooth; it may be grooved, dotted, rough, textured in a fancy pattern or textured randomly. Further, various patterns or designs may be preprinted on the sheets 12, 14, 16.

The preferred embodiment in FIG. 2 includes a thin twist tie 18 made of plastic for attaching the sheets 12, 14, 16 to the insert 10. The tie 18 may be made of wire, nylon, plastic, or any other suitable material that suggests itself. The preferred embodiment utilizes a simple twist tie, but a wire tie, zip tie, ribbon, string, or any other style of tie that suggests itself may be used. Preferably, the tie 18 is a polypropylene ribbon and is about 2¾" in length where an approximately 4" diameter bow is to be formed.

Figure 3:
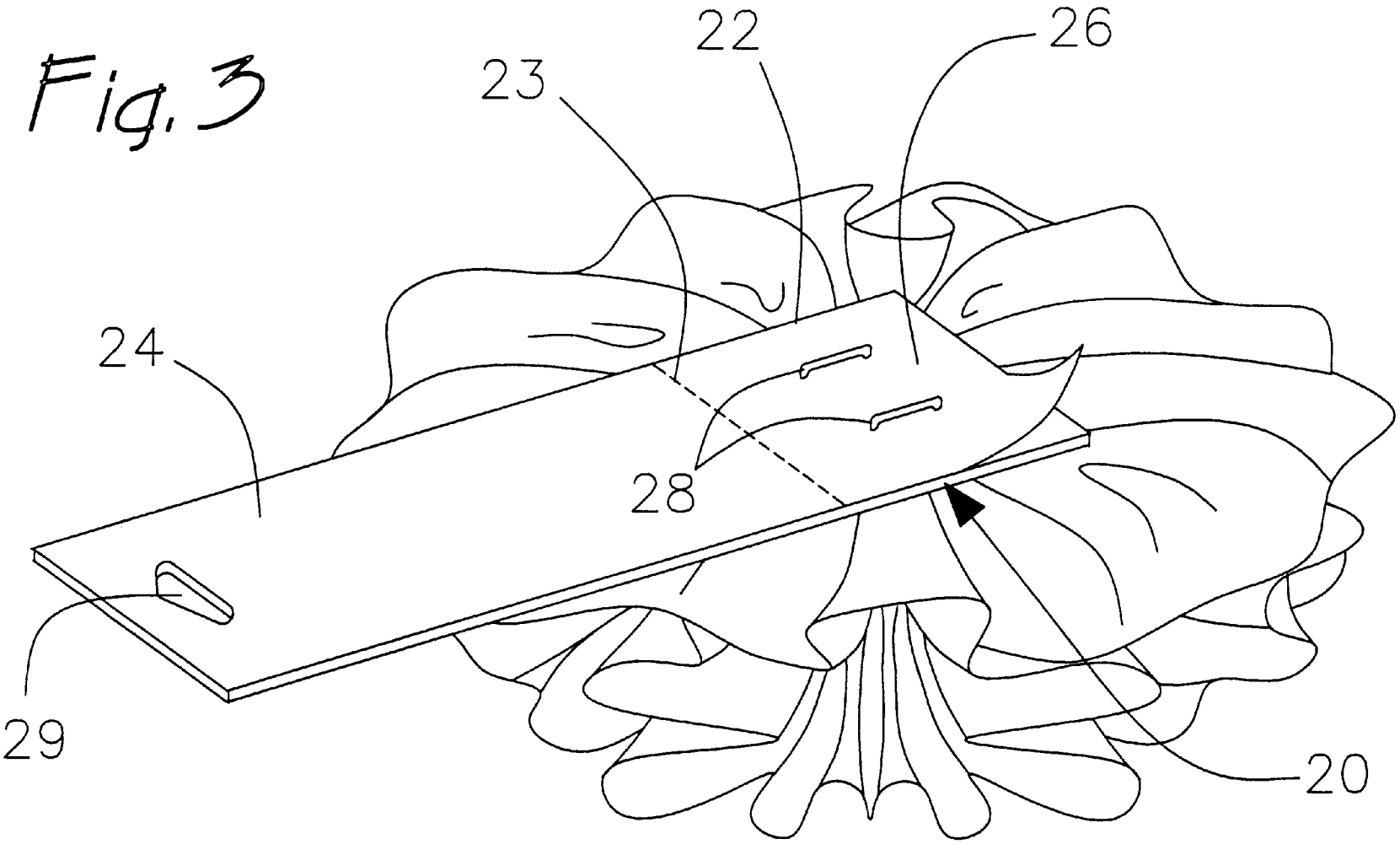
FIG. 3 is a perspective view of the underside of the bow of FIG. 1.
Figure 4:
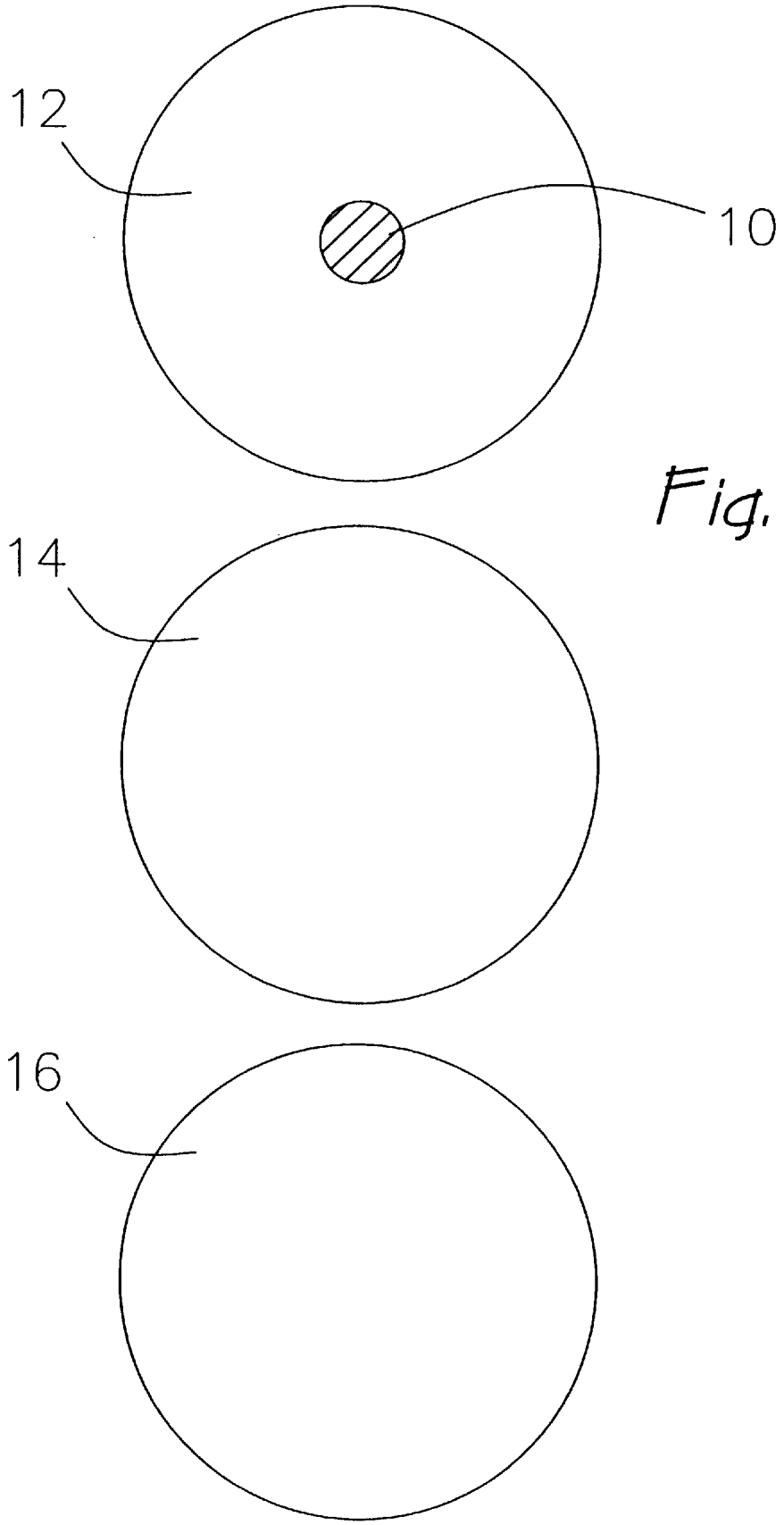
FIG. 4 is a perspective view showing an individual sheet of material for use in the bow of FIG. 1.

The preferred embodiment of the present invention further includes a bow chip 20. The bow chip 20 may consist entirely of an attaching component 22 for attaching the bow chip to the bow and for later attaching the bow to a package. Preferably, the bow chip 20 further comprises a display component 24 as shown in FIG. 3 which is severably attached to the attaching component 22. The bow chip 20 provides a stable backing for the bow 1, and is generally rectangular or square in shape although any suitable shape may be used. The bow chip 20 is preferably formed of a sturdy material such as cardboard, heavy paperboard, paper, or plastic. In the preferred embodiment, the bow chip 20 is stapled to the bow 1. However, the bow chip 20 may also be attached with glue, double sided tape, or any other means that suggests itself. The bow chip 20 may be glued and stapled to the bow.

The attaching component 22 of the bow chip 20 is attached directly to the bow 1 as described above. Preferably, the attaching component 22 has a removable backing 26 on its face opposite the face attaching to the bow 1. The removable backing peels off to expose adhesive which is suitable to attach the bow 1 to a package. One suitable adhesive is Findley Adhesives H2091 brand adhesive having a tackiness of 650 grams/cm2 as measured by polyken probe, but a wide array of adhesives may be used. For example, the adhesive may be weak enough to enable the end user to remove and reuse the bow 1 after it has already been affixed to an object. Or the adhesive may be stronger, affixing the bow 1 more permanently to the desired object.

The preferred embodiment of the bow chip 20 also includes a display component 24 on which text and other information may be printed. An opening 29 strategically located, such as by die-cutting, in the display component 24 permits hanging of the bow on commonly available display racks or other displays at the point of purchase. The opening 29 can be any shape that facilitates hanging the bow 1 on a rack. The shape of the opening 29 in the preferred embodiment enables the bow 1 to hang on a rack with little lateral rotation.

The display component 24 of the bow chip 20 will not always be needed, since the merchant may prefer to sell the bows 1 in bags instead of hanging them on display racks. In addition, the purchaser may not wish the display component to be visible once the bow 1 is attached to a package. The bow chip 20 therefore preferably includes the ability to easily separate the attaching component 22 from the display component 24. This is preferably accomplished using a line of perforations 23 which separates the attaching component 22 and the display component. Alternatively, score lines or other methods commonly known to those in the art may be used to provide for easy separation of the display component 24 from the attaching component 22. The end user may detach the display component 24 by tearing along the line of perforations 23.

It will be appreciated by those skilled in the art that the bow chip 20 could alternatively be formed of some other material, and that all or portions of the bow chip 20 may be formed into any other suitable shape.

In use, the purchaser generally purchases the bow after viewing the bow on a hanging rack in a retail establishment. When the purchaser decides to use the bow, she simply removes the display component 24 by separating along the line of perforations 23. The purchaser then removes the removable backing from the attaching component 22 exposing the adhesive. The user then simply positions the bow at a suitable location on a package or gift bag and presses down on the bow to cause the adhesive to adhere to the surface.

From the foregoing description and examples, it is apparent that the objects of the present invention have been achieved. While only certain embodiments have been set forth, alternative embodiments and various modifications will be apparent to those skilled in the art. These and other alternatives are considered equivalents and within the spirit and scope of the present invention. This application incorporates by reference those applications and patents referenced herein.

What is claimed is:

1. A decorative bow comprising:

an insert;

at least one sheet of material sufficiently flexible to be gathered together, said at least one sheet of material being gathered around said insert;

a tie for fastening said at least one sheet of material together in a gathered configuration wherein said at least one sheet of material when wrapped around said insert and tied with said tie forms a decorative bow.

2. The decorative bow according to claim 1, wherein said at least one sheet of material is at least two sheets.

3. The decorative bow according to claim 1, wherein said at least one sheet of material is at least three or more sheets.

4. The decorative bow according to claim 1, wherein said at least one sheet of material is selected from the group consisting of foil, Mylar, paper, plastic, tulle, fabric and film material.

5. The decorative bow of claim 1, wherein the shape of said at least one sheet of material is selected from the group consisting of a circle, a circle with scalloped edges, a square and a regular polygon.

6. The decorative bow of claim 1, wherein the texture of said at least one sheet of material is selected from the group consisting of smooth texture, grooved texture, dotted texture, rough texture, random texture, and texture of a fancy pattern.

7. The decorative bow of claim 1, wherein said insert is made from material selected from the group consisting of plastic, cardboard, heavy paperboard and paper.

8. The decorative bow of claim 1, wherein the shape of said insert is selected from the group consisting of a circle, square and regular polygon.

9. The decorative bow of claim 1, wherein said tie is selected from the group consisting of a twist tie, wire tie, zip tie, ribbon and string.

10. The decorative bow of claim 1, wherein said tie is made from material selected from the group consisting of wire, nylon and plastic.

11. A decorative bow comprising:

an insert;

at least one sheet of material sufficiently flexible to be gathered together, said at least one sheet of material being gathered around said insert;

a tie for fastening said at least one sheet of material together in a gathered configuration wherein said at least one sheet of material when wrapped around said insert and tied with said tie forms a decorative bow;

a bow chip attached to the bow.

12. The decorative bow according to claim 11, wherein said at least one sheet of material is at least two sheets.

13. The decorative bow according to claim 11, wherein said at least one sheet of material is at least three or more sheets.

14. The decorative bow according to claim 11, wherein said at least one sheet of material is selected from the group consisting of foil, Mylar, paper, plastic, tulle, fabric and film material.

15. The decorative bow of claim 11, wherein the shape of said at least one sheet of material is selected from the group consisting of a circle, a circle with scalloped edges, a square and a regular polygon.

16. The decorative bow of claim 11, wherein the texture of said at least one sheet of material is selected from the group consisting of smooth texture, grooved texture, dotted texture, rough texture, random texture, and texture of a fancy pattern.

17. The decorative bow of claim 11, wherein said insert is made from material selected from the group consisting of plastic, cardboard, heavy paperboard and paper.

18. The decorative bow of claim 11, wherein the shape of said insert is selected from the group consisting of a circle, square and regular polygon.

19. The decorative bow of claim 11, wherein said tie is selected from the group consisting of a twist tie, wire tie, zip tie, ribbon and string.

20. The decorative bow of claim 11, wherein said tie is made from material selected from the group consisting of wire, nylon and plastic.

21. The decorative bow according to claim 11, wherein said bow chip provides a stable backing on which information may be printed.

22. The decorative bow according to claim 11, wherein said bow chip includes a removable pull-off strip exposing adhesive enabling the end user to affix said decorative bow to any desired object.

23. The decorative bow of claim 11, wherein said bow chip includes an extension that facilitates hanging said decorative bow on a display rack.

24. The decorative bow of claim 11, wherein said bow chip is attached to said bow using staples, glue or double-sided tape or combinations thereof.

* * * * *